US007874151B2

(12) United States Patent
Lin et al.

(10) Patent No.: US 7,874,151 B2
(45) Date of Patent: Jan. 25, 2011

(54) DUAL MODE HYDRAULIC CIRCUIT CONTROL AND METHOD

(75) Inventors: Hong-Chin Lin, Glenview, IL (US); Salem Haggag, Cairo (EG)

(73) Assignee: Caterpillar Inc, Peoria, IL (US)

( * ) Notice: Subject to any disclaimer, the term of this patent is extended or adjusted under 35 U.S.C. 154(b) by 485 days.

(21) Appl. No.: 12/049,969

(22) Filed: Mar. 17, 2008

(65) Prior Publication Data

US 2009/0229261 A1 Sep. 17, 2009

(51) Int. Cl.
*F15B 11/16* (2006.01)
*E02F 9/22* (2006.01)

(52) U.S. Cl. ..... 60/422; 60/452

(58) Field of Classification Search ..... 60/422, 60/445, 450, 452; 91/516, 517
See application file for complete search history.

(56) References Cited

U.S. PATENT DOCUMENTS 3,952,509 A 4/1976 Coleman
4,470,259 A 9/1984 Miller et al.
4,664,017 A * 5/1987 Janvrin ..... 91/448
5,295,795 A * 3/1994 Yasuda et al. ..... 60/445
5,297,019 A 3/1994 Zuehlke
5,326,230 A 7/1994 Fischer et al.
5,421,155 A * 6/1995 Hirata et al. ..... 60/452
5,575,148 A * 11/1996 Hirata et al. ..... 60/445
5,873,244 A * 2/1999 Cobo et al. ..... 60/452
6,269,635 B1 8/2001 Zuehlke
6,282,892 B1 * 9/2001 Arai ..... 60/452
6,389,808 B1 * 5/2002 Sakai ..... 60/452
6,481,202 B1 11/2002 Zuehlke et al.
6,931,847 B1 8/2005 Throckmorton et al.

FOREIGN PATENT DOCUMENTS

JP 05-099121 A 4/1993
JP 05-196001 A 8/1993

* cited by examiner

*Primary Examiner*—Thomas E Lazo
(74) *Attorney, Agent, or Firm*—Leydig, Voit & Mayer

(57) ABSTRACT

A dual mode control system for a hydraulic circuit (200) having a variable displacement pump (216) includes at least two actuators, each controlled by a respective valve. The valves are connected in series with a pressure sensor (250) measuring a pressure of fluid between the first valve (224) and the second valve (234) and relaying a signal to the electronic controller (202). The electronic controller (202) operates in a first mode, varying the displacement of the pump (216) based on a command signal operating at least one of the valves, and operates in a standby mode, varying the displacement of the pump (216) based on the signal from the sensor, when both valves are in their respective neutral positions.

20 Claims, 4 Drawing Sheets

DUAL MODE HYDRAULIC CIRCUIT CONTROL AND METHOD

TECHNICAL FIELD

This patent disclosure relates generally to hydraulic systems for vehicles and, more particularly, to vehicles having valves controlling the function of two or more hydraulic actuators associated with the vehicle.

BACKGROUND

Positive flow control systems using open-centered control valves are known. In such systems, a fluid pump provides a flow of fluid to various systems on the vehicle. Fluid flow is continuous at variable rates, sequentially passing through two or more open-centered valves such that operation of various actuators controlled by each of the valves is prioritized. For example, a vehicle having a loader implement may have an open-centered hydraulic system that prioritizes operation of a tilt actuator over a lift actuator by placing the control valve for the tilt actuator upstream of the valve for the lift actuator.

One example of such a hydraulic system can be found in U.S. Pat. No. 5,873,244, issued on Feb. 23, 1999, to Cobo et al. (the '244 patent), the contents of which are incorporated herein in their entirety by reference. The '244 patent discloses a positive flow control system using open-centered control valves connected in series. The system described in the '244 patent uses an orifice placed downstream of the series of valves to regulate flow of pumped fluid passing through each valve when all valves are in a neutral position. One disadvantage of the system disclosed in the '244 patent is that accurate control of fluid flow through the pump when all control valves are in their neutral position is not easily controllable. Another disadvantage is that, typically, the open-centered control valves are calibrated at high engine speeds with hot hydraulic fluid. This arrangement yields inconsistent command dead band when operating at conditions different than the calibration conditions. Moreover, pressure in a typical open-centered system is higher than required when the speed of the engine is high and the temperature of the lubrication fluid is low, and lower than required when the speed of the engine is low and the temperature of the lubrication fluid is high. Under such conditions, the vehicle may experience inadequate lubrication when the pressure is low or waste engine power when the pressure is high.

SUMMARY

The disclosure describes, in one aspect, a dual mode control system for a hydraulic circuit having a variable displacement pump and including at least two actuators. Each actuator is controlled by a respective valve, with the valves connected in series. A first pressure sensor measures a first pressure of fluid between the pump and the first valve, relaying a first signal to the electronic controller. A second sensor relays a second signal to the electronic controller that is indicative of a second pressure measured between the first valve and the second valve. The electronic controller can operate in a first mode, varying the displacement of the pump based on the first pressure when at least one of the valves is positioned to activate an actuator, and in a second mode, varying the displacement of the pump based on the second signal when both valves are in their respective neutral positions.

In another aspect, the disclosure describes a dual mode hydraulic circuit associated with a hydrostatically operated vehicle. The vehicle includes a variable displacement hydraulic pump operably connected to an engine. The vehicle may further include an implement operated by a first and second hydraulic pistons, the first and second hydraulic pistons selectively receiving a flow of hydraulic fluid from the pump. A first valve controls the flow of fluid operating the first hydraulic piston, and a second valve controls the flow of fluid operating the second hydraulic piston. A supply conduit fluidly connects the pump with the first valve, and an intermediate conduit fluidly connects the first valve with the second valve. A first pressure sensor measures fluid pressure in the supply conduit yielding a first signal relayed to an electronic controller. Similarly, a second pressure sensor measures fluid pressure in the intermediate conduit yielding a second signal. The controller may operate in a first mode when at least one of the first and second valves is not in a neutral position, varying the displacement of the pump based on the first signal, and in a second mode when the first valve and the second valve are in the neutral position, varying the displacement of the pump based on the second signal.

In yet another aspect, the disclosure describes a method of controlling a hydraulic circuit. The method includes determining whether at least one of the first and second command signals is inactive. When at least one of the first and second command signal is active, a mode selector is set to a first mode value and the actuators are controlled accordingly. When in the first mode, a first pressure of fluid disposed between the pump and the first valve is sensed, and the displacement of the pump is set based on the first pressure. When both the first and second command signals become inactive, the mode selector is set to a second mode value, a second pressure of fluid disposed between the first valve and the second valve is sensed, and the displacement of the pump is set based on the second pressure rather than the first pressure.

DETAILED DESCRIPTION

This disclosure relates to vehicles having hydraulic systems for operating various functions of the vehicle, for example, the motion and material handling functions of a wheel loader. Even though a wheel loader is used for illustration, it is understood that the systems and methods disclosed herein have universal applicability and are suited for other types of vehicles, for example, trucks, backhoe loaders, compactors, harvesters, graders, tractors, pavers, scrapers, skid steer and tracked vehicles, and so forth.

Figure 1:
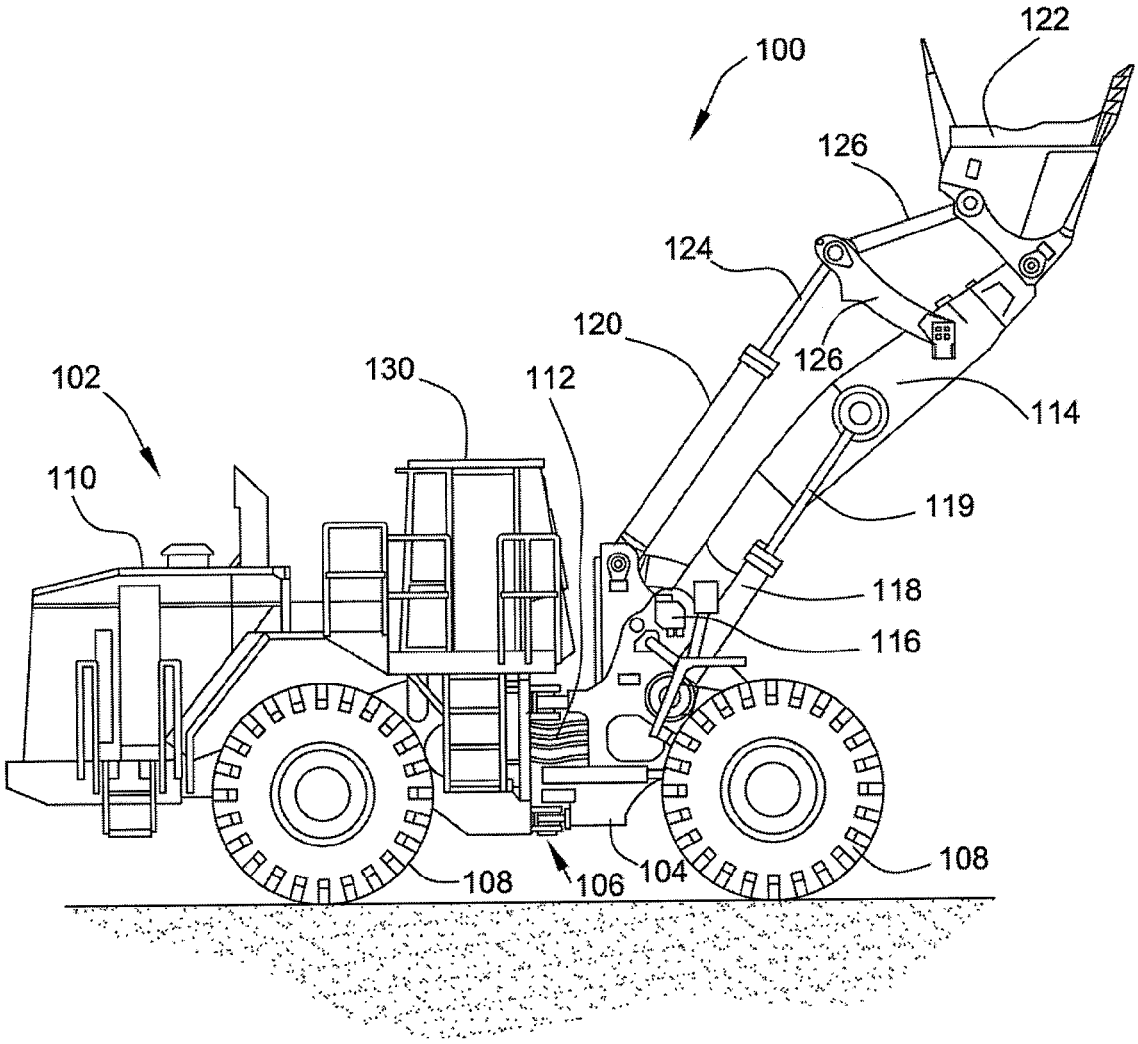
FIG. 1 is an outline view of a wheel loader in accordance with the disclosure.

FIG. 1 shows an outline of a wheel loader as one example for a vehicle 100. The wheel loader vehicle 100 is one example of a hydrostatically operated vehicle. Hydrostatically operated vehicles are vehicles having hydraulic systems associated therewith that are operable to move or propel the vehicle and/or actuate various work implements associated or integrated with the vehicle. The vehicle 100 includes an engine frame portion 102 connected to a non-engine frame portion 104 by an articulated joint 106. Each of the engine frame portion 102 and non-engine frame portion 104 includes a respective axle connected to a set of wheels 108. The engine frame portion 102 includes the engine 110, which operates a hydraulic pump (not shown). The pump impels a flow of fluid through a network of fluid conduits 112 extending to various components and actuators of the vehicle 100.

A pair of lift arms 114 is connected to the non-engine frame portion 104 of the vehicle 100 at a hinge 116. The hinge 116 allows the lift arms 114 to pivot with respect to the non-engine frame portion 104. Motion of the lift arms 114 is controlled by a hydraulic cylinder or lift actuator 118. The lift actuator 118 is hingeably connected on both ends between the non-engine frame portion 104 and the lift arms 114 such that the lift arms 114 may pivot upwards when the lift actuator 118 extends its telescoping ram 119. The telescoping ram 119 of the lift actuator 118 is connected to a piston (not shown) that moves when a fluid under pressure is introduced on one side of the piston via the fluid conduits 112. In a similar fashion, a tilt actuator 120 is pivotally connected to the non-engine frame portion 104 operating to tilt a bucket 122 pivotally connected to a distal end of the lift arms 114. The telescoping ram 124 of the tilt actuator 120 may be connected to the bucket 122 via two intermediate linkages 126. Motion of the various portions of the vehicle 100 can be controlled via appropriate devices by an operator occupying the cab 130 of the vehicle 100 during operation.

Figure 2:
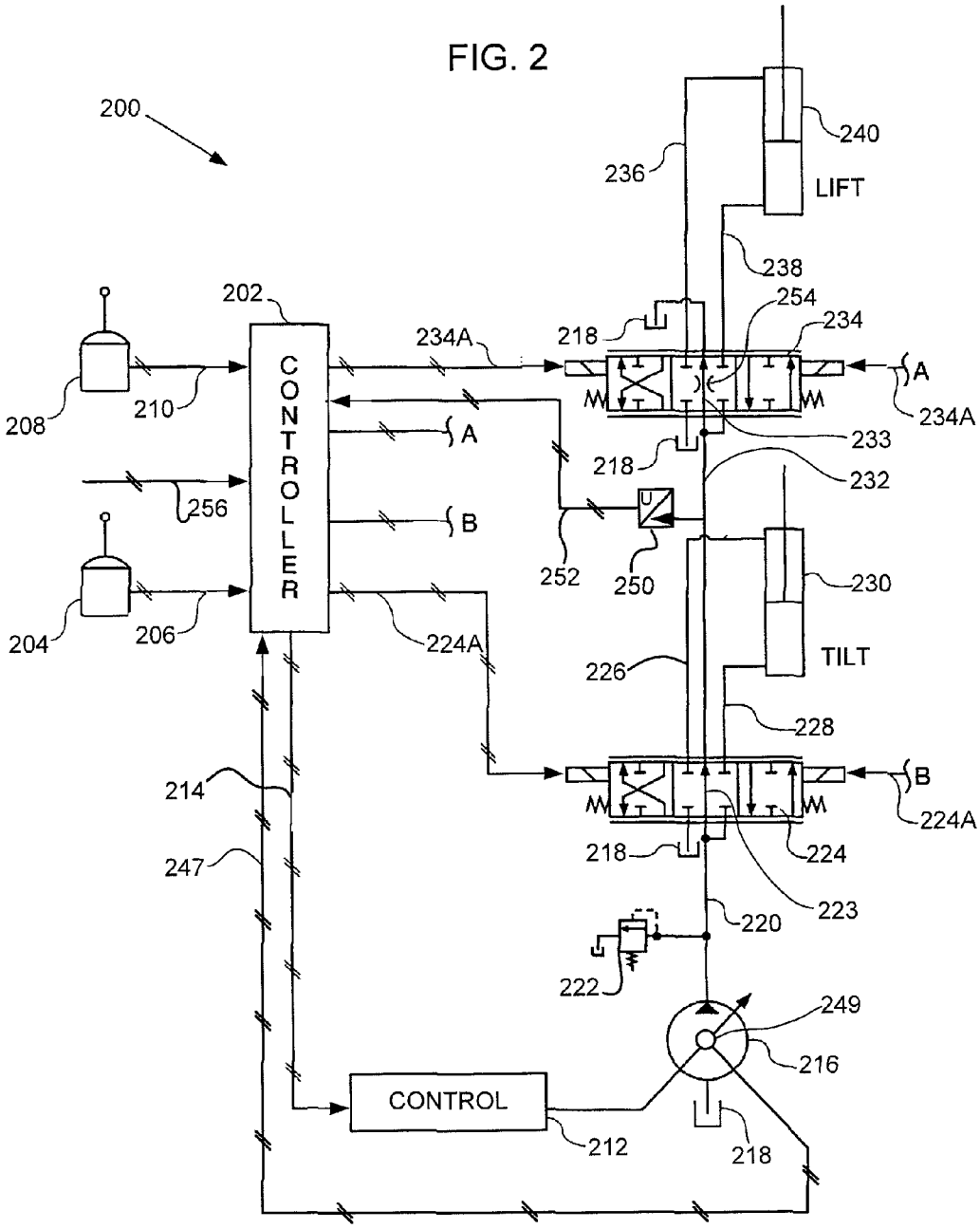
FIG. 2 is schematic for a dual mode hydraulic system in accordance with the disclosure.

A block diagram of a simplified hydraulic circuit 200 is shown in FIG. 2. The hydraulic circuit 200 may be used to control various components and actuators on a vehicle, for example, the vehicle 100 shown in FIG. 1, or any other vehicle having hydraulic drive and/or implement actuation systems. The hydraulic circuit 200 is shown simplified for the sake of illustration, but may include additional components.

The hydraulic circuit 200 includes a controller 202 connected to a tilt control 204 via a tilt control line 206, and to a lift control 208 via a lift control line 210. The tilt control line 206 and lift control line 210 may be any appropriate type of communication linkage between the controller 202 and, respectively, the tilt control 204 and lift control 208. The tilt control 204 and lift control 208 may be handled by an operator during operation, for example, to control tilt of the tilt arms 114 and lift of the bucket 122 of the vehicle 100 shown in FIG. 1.

The controller 202 is connected to a pump control 212 via a communication line 214. The pump control 212 may be an electronic actuator arranged to change the displacement of a variable displacement hydraulic pump 216. The pump 216 may be operated by the engine of the vehicle (not shown) and function to draw a flow of hydraulic fluid from a reservoir or drain 218, and pump the fluid into a supply conduit 220. A pressure relief valve 222 may limit the maximum pressure allowed in the supply conduit 220 by draining excess fluid to the drain 218. During operation, fluid in the supply conduit 220 is routed to a first open-center port 223 of a first four-port three-position (4-3 way) valve 224. The first 4-3 way valve 224 is connected to a tilt piston 230 via a first and second tilt piston conduits 226 and 228. The first 4-3 way valve 224 is arranged for selectively routing high pressure fluid from the supply conduit 220 on one side of the tilt piston 230, while simultaneously draining the other side to the drain 218, thus causing the tilt piston 230 to move in one direction or the other. Selective routing of high pressure fluid to either side of the tilt piston 230 occurs when the first 4-3 way valve 224 is displaced from its neutral position. In the embodiment shown, actuation of the first 4-3 way valve 224 may be accomplished by a pair of first valve actuators 224A connected to the controller 202 and arranged to push and/or pull the first 4-3 way valve 224 from the neutral position into one of two operating positions. When the first 4-3 way valve 224 is in the neutral position, the first open-center port 223 thereof routes the flow of fluid from the pump 216, through the first 4-3 way valve 224, and into an intermediate supply conduit 232.

Fluid in the intermediate supply conduit 232 is routed to a second open-center port 233 of a second 4-3 way valve 234. The second 4-3 way valve 234 is connected to a lift piston 240 via a first lift piston conduit 236 and a second lift piston conduit 238, which are arranged for selectively routing high pressure fluid from the intermediate supply conduit 232 on one side of the lift piston 240 at a time. As before, selective routing of high pressure fluid to either side of the lift piston 240 occurs when the second 4-3 way valve 234 is displaced from its neutral position. In the embodiment shown, actuation of the second 4-3 way valve 234 may be accomplished by a pair of second valve actuators 234A connected to the controller 202 and arranged to push and/or pull the second 4-3 way valve 234 from the neutral position into one of two operating positions.

A pressure sensor 250 is fluidly connected to the intermediate supply conduit 232. The pressure sensor 250 is also electronically connected to the controller 202 via a second sensor communication line 252. The pressure sensor 250 is arranged to sense pressure of the hydraulic fluid within the intermediate supply conduit 232 and relay information indicative of the pressure to the controller 202. This information can be used by the controller to, for example, compensate for temperature variations during operation, and to serve as a basis for control of the displacement of the pump 216 under certain operating conditions. The controller 202 may also receive information about the displacement of the pump 216 via a position feedback line 247 connecting the controller 202 with a pump displacement sensor 249.

When both the first 4-3 way valve 224 and second 4-3 way valve 234 are in their respective neutral positions, the flow of fluid from the pump 216 passes through the first open-center port 223 of the first 4-3 way valve 224 and through the second open-center port 233 of the second 4-3 way valve 234, which contains a constriction or orifice 254, before returning to the drain 218. In this operating condition, the hydraulic circuit 200 may be considered to be in a first or standby mode of operation. While the hydraulic circuit 200 is in the standby mode of operation, a minimum desired pressure of fluid is maintained between the pump 216 and orifice 254 such that an adequate supply of fluid is available when actuation of a piston is required. Moreover, adequate flow of fluid through the hydraulic circuit 200 during standby operation may ensure good pump lubrication, smooth start of motion for the various actuators, and reduced control lever dead band at low engine speeds. Displacement of one of the first or second 4-3 way valves 224 and 234 from their respective neutral positions will change the operating mode of the hydraulic circuit 200 from the first or standby mode to a second or operational mode. In the operational mode, a steady supply pressure is maintained to ensure an adequate supply of fluid reaching the tilt pistons 230 or lift pistons 240. Further, an engine communication line 256 relays information indicative of various operating parameters of the engine to the controller 202.

Figure 3:
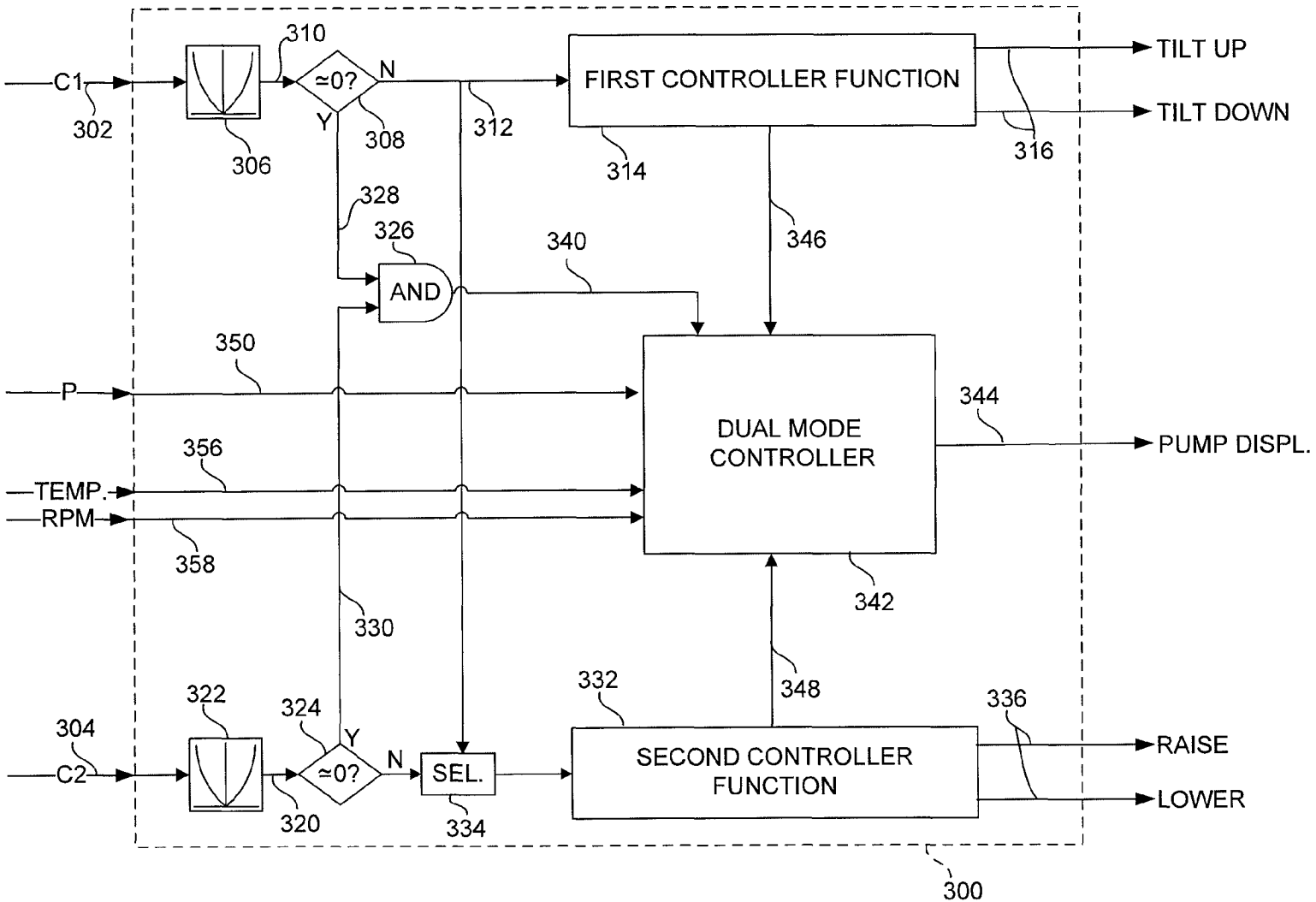
FIG. 3 is a block diagram for a controller in accordance with the disclosure.

A schematic for a controller 300 in accordance with the disclosure is shown in FIG. 3. The controller 300 is advantageously arranged to electronically receive various command signals and operating parameters related to a hydraulic system. The controller 300 is shown for illustration of a number of the control concepts disclosed herein, and should not be construed as limiting to the scope of the claims as set forth.

More specifically, the controller 300 is configured to receive a first control signal, C1, via a first input node 302. The first control signal C1 may be an electronic signal generated by a position sensor associated with a control lever or other appropriate device that is indicative of a displacement position of the control device by the operator. Similarly, a second control signal, C2, enters the controller 300 via a second input node 304. The signal C1 may be processed with a normalization function 306 before entering a first neutrality determinator 308. The normalization function 306 may operate to transform the signal C1, for example, from a ±5 volt analog signal to a ±1 non-dimensional parameter for use in the subsequent logic operations. It can be appreciated that this transformation is optional, suited for different implementations, and may also include an analog to digital conversion, filtering, or other functions. In this embodiment, the sign of the non-dimensional parameter exiting the normalization function 306 at a first output node 310 may be indicative of the direction of actuation, while the magnitude thereof may be indicative of the extent of actuation.

The first neutrality determinator 308 determines whether the non-dimensional parameter is equal to zero or, alternatively, whether the first control signal C1 is inactive or neutral. Neutrality of the first control signal C1 indicates that the operator of the vehicle does not desire a change in position of the first actuator, for example, the lift piston 240 shown in FIG. 2. When the first control signal C1 is not at a neutral condition, the first neutrality determinator 308 may pass the non-dimensional parameter from the first output node 310 through to a first control input node 312. The first control input node 312 may be connected to a first controller function 314 having two control outputs 316. The control outputs 316 may be arranged to command motion of a linear actuator in either direction. The first controller function 314 may be, as indicated, an open loop controller commanding a displacement of the actuator, for example, the lift piston 240 shown in FIG. 2, along a desired direction and for a desired magnitude. Function of the first controller function 314 may be based on various control schemes, for example, by use of a table lookup function, a computational equation, a modeling algorithm, and so forth.

In a similar fashion, the second control signal C2 is converted to a non-dimensional parameter routed to a second output node 320 via an additional normalization function 322. The second output node 320 leads to an additional neutrality determinator 324. The neutrality determinator 308 and additional neutrality determinator 324 are each connected to a logical AND gate 326 via, respectively, a first neutral indicator node 328 and a second neutral indicator node 330. When the first neutral indicator node 328 is not active, i.e. when C1 is not neutral, the non-dimensional control signal at the second output node 320 is prevented from reaching a second controller function 332. This can be accomplished by introduction of an intervening selector switch 334 connected to the first control input node 312. This interruption is optional and consonant to the prioritized operation of an open-centered hydraulic system, such as the hydraulic circuit 200 shown in FIG. 2 where operation of one actuator is prioritized over operation of another by placement of respective valves in series with each other along a hydraulic fluid line. By interrupting the signal going to the second controller function 332 when the first controller function 314 is active, potential issues of controller windup or false-positive system diagnostic determinations can be avoided.

When the first control signal C1 is neutral and the second control signal C2 is commanding a displacement, the selector switch 334 may pass the non-dimensional parameter from the second output node 320 into the second controller function 332. The second controller function 332 is arranged to issue commands to a second actuator via two additional control outputs 336. The additional control outputs 336 may, as above, act to respectively cause another actuator to move, for example, one operating to raise or lower the arms of a loader. As in the case of the first controller function 314, the second controller function 332 may be an open loop controller but other control configurations may be used.

The AND gate 326 may operate as a mode selector for the controller 300. When the operator causes activation of either command signal C1 or C2, the controller 300 operates in a first or operating mode. Motion of the actuator(s) in this first mode is accomplished by commands issued by the first and/or second controller functions 314 and 332. It can be appreciated that during operation in the first mode, at least one of the two neutrality determinators 308 and 324 will not have its respective first and second neutral indicator nodes 328 or 330 active, causing the output mode selector node 340 from the AND gate 326 to be inactive or zero. The mode selector node 340 is connected to a dual mode controller 342 arranged to control the displacement of a hydraulic pump via a pump control node 344.

While the controller 300 operates in the first mode, the dual mode controller 342 may control displacement of the pump based on the first or second command signals C1 and C2 as relayed to the dual mode controller 342, respectively, by a first indicator 346 from the first controller function 314 and a second indicator 348 from the second controller function 332. The first and second indicators 346 and 348 may be indications from each respective first and second controller function 314 and 332 of the pump setting that is required to meet demand. Control of the pump displacement via the pump control node 344 during the first mode is accomplished in an open loop fashion, with optional corrections for changes in engine speed and hydraulic fluid temperature. A value indicative of the temperature of hydraulic fluid is relayed to the dual mode controller 342 via a temperature input node 356, while information indicative of the engine speed is relayed via an engine speed input node 358.

When both the first and second control signals C1 and C2 are neutral, the output of the AND gate 326 at the mode selector node 340 is activated, for example, by changing from zero to one as both "conditions" of the AND gate 326 become "true." Activation of the mode selector node 340 is relayed to the dual mode controller 342 indicating that a change or transition of operating mode is required.

Activation of the mode selector node 340 indicates that the controller 300 switches its mode into a second or standby mode of operation. When the controller 300 operates in the standby mode, a pressure P present at a pressure node 350 is used for feedback to the dual mode controller 342. The pressure P may be measured before a return flow orifice in an open-centered flow system, for example, the pressure measured by the pressure sensor 250 before the orifice 254 in the hydraulic circuit 200 shown in FIG. 2. The pressure P may advantageously have a narrow range but great accuracy in conditions of low engine speed or low fluid flow rate. Use of the pressure P for feedback for the dual mode controller 342 is better suited for control of the pump while the system is in standby mode.

Control of pump displacement by use of two modes of operation advantageously avoids issues of pressure variation when the vehicle is operating in a standby mode. Moreover, pump commands resulting from each control scheme during operation under each mode can be combined when transitioning into and out from the standby mode of operation. For example, the command for pump displacement generated based on the pressure feedback during the second or standby mode of operation may be used during operation in the first or active mode as a feed-forward value or command to the pump. In this fashion, the pressure in the system is always assured to be within an acceptable range. In controllers where lookup tables are used to yield commands to the pump that are proportional to each control signal C1 and C2, the command signal resulting from the standby mode of operation based on the pressure P can serve as a dynamic zero value representing the minimum pressure at the outlet of the pump when no commands are present. In this situation, the lookup tables can advantageously shift such that any setting of the pump can be interpolated to correspond to the pressure P at the outlet of the pump.

Figure 4:
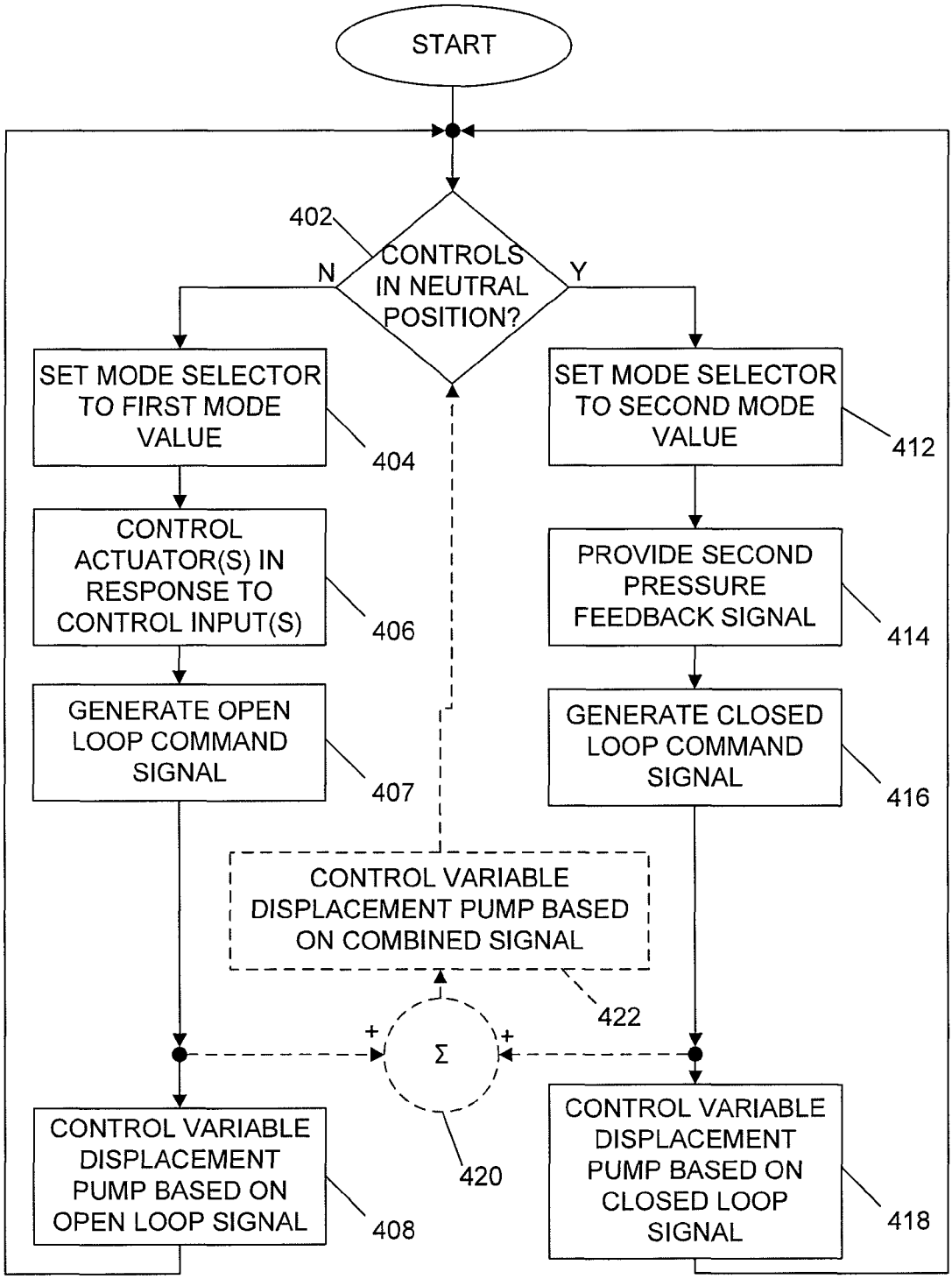
FIG. 4 is a flowchart for a method of controlling a hydraulic system in accordance with the disclosure.

A flowchart for a method of controlling a hydraulic circuit using two modes of operation is shown in FIG. 4. A determination of the state of the circuit is made at 402. The determination at 402 may include determining whether at least one control input is in a neutral position and, in the case when more control inputs are present, whether more than one or all control inputs are in the neutral position. When at least one control input has been determined not to be in the neutral position, a mode selector is set to a first mode value at 404, for example, a value of zero. At least one actuator is controlled at 406 in response to the control input commands. An open-loop command signal is generated at 407, and the variable displacement pump is controlled at 408 based on the open loop command signal such that an adequate supply of fluid is provided to actuate the at least one actuator, for example, by adjusting displacement of the pump based on the control command that is active.

When all control inputs of the system are determined to be at the neutral position, the mode selector is set to a standby mode value at 412, for example, a value of 1. In the standby mode, a feedback pressure measured at a location downstream of at least one open-centered valve is provided at 414. A closed loop command signal is generated at 416 and the variable displacement pump is controlled at 418 based on the close loop command signal. The determination at 402 is repeated while all control inputs are at the neutral position. Optionally, the closed loop control signal output from 416 may be added to the open loop control signal at 407 to provide a combined pump command signal at a summing junction 420, shown in dashed line. The variable displacement pump may be controlled based on the combined command signal at 422.

INDUSTRIAL APPLICABILITY

The present disclosure is applicable to open-centered hydraulic systems for hydrostatically operated actuators. The system, controller, and method disclosed herein advantageously enable operation of the vehicle and the various actuators associated therewith without the various issues encountered in the past. For example, use of a pressure sensor for closed loop control of the displacement of the hydraulic pump during operation in a second or standby mode enables a more accurate control of the pressure and flow of hydraulic fluid and avoids dead band in the control devices as well as promotes smooth initiation of actuation. Moreover, use of a separate pressure sensor having greater accuracy at larger pressures and flow rates during a first or operating mode of operation helps ensure proper and optimal control of the pump. By switching between an operating and a standby modes within the controller, and by using separate pressure sensors and control schemes for each mode, the present disclosure provides a universally applicable solution for controlling operation of hydraulic systems. Even though the exemplary embodiment for a hydraulic circuit presented herein includes two actuators or pistons, it can be appreciated that the disclosure is applicable to circuits including fewer or more actuators.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A hydraulic circuit operably associated with a vehicle, the hydraulic circuit including a variable displacement pump operated by an engine, the hydraulic circuit comprising:

a first hydraulic actuator controlled by a first valve responsive to a first command signal, the first valve fluidly connected to an outlet of the pump;

a second hydraulic actuator controlled by a second valve responsive to a second command signal, the second valve fluidly connected in series with the first valve, the first valve disposed between the second valve and the outlet of the pump;

a sensor disposed in fluid communication with an intermediate conduit fluidly connecting the first valve with the second valve and measuring a pressure, the sensor relaying a signal to the electronic controller;

the electronic controller disposed to operate in a first mode of operation when at least one of the first and second command signals is active; and the electronic controller disposed to operate in a standby mode of operation when the first and second command signals are inactive, the controller varying the displacement of the pump based on the signal.

2. The hydraulic circuit of claim 1, wherein the electronic controller is further disposed to vary the displacement of the pump based on at least one of the first and second command signals.

3. The hydraulic circuit of claim 1, wherein the first valve is a four-port three-position (4-3 way) valve having a center port that is fluidly open when the first valve is in a neutral position.

4. The hydraulic circuit of claim 1, wherein the second valve is a four-port three position (4-3 way) valve having a center port that is fluidly open when the second valve is in a neutral position.

5. The hydraulic circuit of claim 4, further comprising an orifice opening formed around the center port of the second valve.

6. The hydraulic circuit of claim 5, wherein the orifice opening is disposed to constrict a flow of fluid passing through the second valve when the second valve is in the neutral position.

7. The hydraulic circuit of claim 1, wherein the electronic controller operating in the first mode varies the displacement of the pump, at least in part, based on the signal from the sensor.

8. The hydraulic circuit of claim 1, further including a drain, wherein a flow path is created between the pump, the first valve, the second valve, and the drain when the electronic controller is operating in the standby mode.

9. The hydraulic circuit of claim 1, wherein the electronic controller operating in the first mode is disposed to control at least one of the first and second hydraulic actuators independently from the signal from the sensor.

10. The hydraulic circuit of claim 1, wherein the electronic controller operating in the first mode is disposed to control the pump based on one of the first command signal and the second command signal, and is further disposed to correct the control of the pump based on the signal from the sensor.

11. A hydrostatically operated vehicle having a variable displacement hydraulic pump operably connected to an engine, the vehicle comprising:

an implement operated by a first and second hydraulic pistons, the first and second hydraulic pistons disposed to selectively receive a flow of hydraulic fluid from the pump;

a first valve disposed to receive the flow of hydraulic fluid from the pump and control the flow of fluid operating the first hydraulic piston;

a second valve disposed to receive the flow of hydraulic fluid from the pump and control the flow of fluid operating the second hydraulic piston;

a supply conduit fluidly connecting the pump with the first valve;

an intermediate conduit fluidly connecting the first valve with the second valve;

a pressure sensor disposed to measure fluid pressure in the intermediate conduit, the pressure sensor yielding a pressure signal;

an electronic controller disposed to control the first and second valves, vary the displacement of the pump, and receive the pressure signal;

the electronic controller operating in a first mode when at least one of the first and second valves is not in a neutral position;

the electronic controller operating in a standby mode when the first valve and the second valve are in the neutral position, the controller varying the displacement of the pump based on the pressure signal.

12. The hydrostatically operated vehicle of claim 11, wherein the controller operates to vary the displacement of the pump based on the flow of fluid operating one of the first hydraulic piston and the second hydraulic piston.

13. The hydrostatically operated vehicle of claim 11, wherein the implement is a loader implement including a set of lifting arms and a bucket, wherein the first hydraulic piston operates to selectively tilt and lower the arms, and wherein the second hydraulic piston operates to selectively lift the bucket.

14. The hydrostatically operated vehicle of claim 11, wherein the first valve is a four-port three-position (4-3 way) valve, the first 4-3 way valve having two actuated positions and a neutral position, the first 4-3 way valve allowing fluid flow therethrough when in the neutral position.

15. The hydrostatically operated vehicle of claim 11, wherein the second valve is a four-port three-position (4-3 way) valve, the second 4-3 way valve having two actuated positions and a neutral position, the second 4-3 way valve having an orifice constricting fluid flow therethrough when in the neutral position.

16. A method of operating a hydraulic system, the system including a variable displacement pump fluidly connected to a first valve via a supply conduit, the first valve operating to control a flow of fluid operating a first actuator, the first valve fluidly connected to a second valve operating to control the flow of fluid operating a second actuator, the first valve responsive to a first command signal, the second valve responsive to a second command signal, the method comprising:

determining whether at least one of the first and second command signal is inactive;

when the first and second command signals are inactive;

sensing a pressure of fluid disposed between the first valve and the second valve, and setting a displacement of the pump based on the pressure.

17. The method of claim 16, further including controlling at least one of the first and second actuator in response to, respectively, at least one of the first and second command signal when at least one of the first and second command signal is active.

18. The method of claim 17, further including sensing a temperature of fluid disposed between the pump and the first valve.

19. The method of claim 18, further including setting a displacement of the pump based on the temperature of fluid when at least one of the first and second command signal is active.

20. The method of claim 16, further comprising constricting a flow of fluid passing through the second valve with an orifice when the first and second command signals are inactive.

* * * * *